US005537897A

United States Patent [19]

Wilson, Jr.

[11] Patent Number: 5,537,897

[45] Date of Patent: Jul. 23, 1996

[54] SPLIT SOCKET WITH MOVABLE FACETS AND DRIVE ASSEMBLY

[76] Inventor: David Wilson, Jr., 8022 Dry Creek Cir., Longmont, Colo. 80503

[21] Appl. No.: 307,349

[22] Filed: Sep. 16, 1994

Related U.S. Application Data

[63] Continuation-in-part of Ser. No. 276,506, Jul. 18, 1994, Pat. No. 5,460,062, and Ser. No. 299,211, Aug. 31, 1994, which is a continuation-in-part of Ser. No. 276,506, which is a continuation of Ser. No. 25,949, Mar. 3, 1993, abandoned.

[51] Int. Cl.[6] ..... B25B 17/00

[52] U.S. Cl. ..... 81/56; 81/58.2; 81/91.1

[58] Field of Search ..... 81/57.14, 57.3, 81/58.2, 91.1, 56

[56] References Cited

U.S. PATENT DOCUMENTS

| | | | |
|---|---|---|---|
| 1,648,134 | 11/1927 | Kientz . | |
| 2,537,175 | 1/1951 | Viets . | |
| 2,551,669 | 5/1951 | Hale . | |
| 2,578,686 | 12/1951 | Fish . | |
| 2,630,731 | 3/1953 | Imboden . | |
| 2,649,823 | 8/1953 | Markovich . | |
| 2,700,315 | 1/1955 | Hermanson | 81/58.2 |
| 2,712,259 | 7/1955 | Cowell . | |
| 2,719,446 | 10/1955 | Ford | 81/57.3 |
| 3,079,820 | 3/1963 | Vantchoura . | |
| 3,602,071 | 8/1971 | Juhasz | 81/57.3 X |
| 3,620,105 | 11/1971 | Batten . | |
| 3,927,582 | 12/1975 | Hertelendy et al. . | |
| 4,374,479 | 2/1983 | Minotti . | |
| 4,402,239 | 9/1983 | Mooney . | |
| 4,972,741 | 11/1990 | Sibille . | |
| 5,050,463 | 9/1991 | Stielow . | |
| 5,161,438 | 11/1992 | Pietras . | |
| 5,161,439 | 11/1992 | Wesch, Jr. . | |
| 5,259,275 | 11/1993 | Schulze-Beckinghausen . | |
| 5,271,298 | 12/1993 | Gazel-Anthoine . | |

*Primary Examiner*—James G. Smith
*Attorney, Agent, or Firm*—Harold A. Burdick

[57] ABSTRACT

A split socket having movable fitting contacting facets and a drive transfer assembly are disclosed which are particularly well suited for manipulating line fittings. The split socket preferably includes first and second movable dogs pivotably mounted at opposite surfaces of an opening in a rotatable socket. The socket opening is at least as wide as the point-to-point diameter of the fitting to be received thereat. Each of the dogs has a facet configured for engaging and thereby, in conjunction with one another, rotating the fitting when the socket is rotated in a first direction, the dogs being movable by the fitting away from engagement when the socket is rotated in the opposite direction, thus allowing rotation of the socket in the opposite direction while the fitting remains substantially still. The drive transfer assembly includes a housing and drive gear or gear train, the housing being configured to admit the fitting to the socket opening directly therethrough and to assure proper orientation of the fitting, once admitted, relative to the socket.

19 Claims, 9 Drawing Sheets

SPLIT SOCKET WITH MOVABLE FACETS AND DRIVE ASSEMBLY

RELATED APPLICATION

This application is a continuation-in-part of now pending U.S. patent application Ser. No. 08/299,211 filed Aug. 31, 1994 and entitled "Mechanism For Locating A Slotted Socket Relative To A Drive Transfer Housing And Combination Thereof" by David Wilson Jr. and Bruce D. Stefen, (which is a continuation-in-part of now pending U.S. patent application Ser. No. 08/276,506 filed Jul. 18, 1994, now U.S. Pat. No. 5,460,062, and entitled "Reaction Unit for Threaded Connector Manipulating Device and Combination Thereof" by David Wilson, Jr., U.S. Pat. No. 5,460,062 being a file wrapper continuation of now abandoned U.S. patent application Ser. No. 08/025,949 filed Mar. 3, 1993 and entitled "Compact Manipulating Device For Threaded Connectors" by David Wilson, Jr.), and is a continuation-in-part of U.S. Pat. No. 5,460,062 as further identified hereinabove.

FIELD OF THE INVENTION

This invention relates to fitting manipulating tools such as wrenches, sockets and socket drivers, and, more particularly, relates to slotted wrenches, sockets and drivers.

BACKGROUND OF THE INVENTION

Wrenches and sockets having a gap at one part thereof to allow passage of a line into the tool are well known (in the case of sockets, being generically referred to as split, or slotted, sockets). In the actual use of many now known slotted sockets on a line fitting, a sequence of specific steps is required to use the tool. First, the slot in the socket and the slot in a socket driver housing must be brought into correspondence to allow proper positioning of the fitting in the socket.

The continuous line is then introduced to the center of the socket and the tool is moved axially until the multi-faceted annulus of the socket is engaged on the nut. The operator of the tool may then actuate rotation of the socket to rotate the fitting as desired, after which the tool is moved axially off the fitting. Typically the slot of the socket and the slot of the housing are not in agreement after the operation thus often requiring the operator to again bring the slots into correspondence for removal of the tool from the line.

The principal disadvantage to the current method of use of such tools is the need for clearance above or below the fitting for maneuvering the tool into operative position (with the socket engaged on the fitting) and for moving the socket off the fitting to realign the gaps so that the tool can be removed from the line without continuing to turn the fitting (necessary to prevent over or under torquing, accidental reengagement or the like). Such clearances are not always available, or, if made available (of necessity for maintenance in a particular application), may have inhibited optimal design of the structure.

Moreover, the diameter of a hydraulic line needs to be smaller than the flat to flat dimension of the socket (i.e., the distance between directly opposite fitting engaging facets) in order for many heretofore known tools to be used. This has been due to the necessity for movement of the socket along the line to achieve engagement and/or disengagement from the fitting. It is thus apparent that further improvement of such tools could be utilized to achieve greater flexibility and ease of use.

One solution to some of the foregoing problems involves ratcheting type tools which are configured to turn the fitting when moved in one direction but not when rotated in the other (see, for example, U.S. Pat. Nos. 2,712,259, 2,537,175, 2,578,686, 2,649,823, 2,551,669 and 3,927,582). These tools, however, have often involved numerous parts, cumbersome, complex and/or easily damaged structure, and have not always been easily adapted for use in confined spaces and/or with power driving mechanisms. Various other tools have been suggested which use gear driven sockets or the like (see U.S. Pat. Nos. 5,050,463, 3,620,105, 4,374,479, 2,630,731 and 1,648,134). These tools, however, also do not always provide for minimal manual manipulation of the tool during use, and/or do not always optimize flexibility and ease of utility, mechanical durability and thus reliability, and compactness of structure.

SUMMARY OF THE INVENTION

This invention provides a tool, such as a split socket, having means movably, preferably pivotably, connected at a rotatable body for contacting to rotate a fitting when the socket body is rotated in one direction and contacting and pivoting away from the fitting when the body is rotated in the other direction. The socket is formed with an opening in the socket equivalent to or greater than the greatest diameter of the fitting to be manipulated. A related drive transfer assembly is also provided.

The split socket of this invention includes a manipulable body having an inner periphery, the inner periphery having first and second opposing, substantially parallel surfaces defining a fitting receiving gap in the body and being spaced apart a distance at least equal to the greatest diameter of the fitting to be manipulated. At least a first member having a facet for contacting at least one side of the fitting to manipulate the fitting is movably mounted adjacent to one of the surfaces of the inner periphery of the body. The member is preferably pivotably mounted at the first surface, and a second member is preferably pivotably mounted at the second surface.

The drive transfer assembly of this invention includes compact housing, is releasably engagable with a power driver, and is complimentarily configured with the split socket to minimize the necessity for preliminary manipulation of any of the socket, drive assembly, the fitting or the surrounding equipment or structure to achieve positioning of the socket on the fitting, operation of the device, or removal of the socket from the fitting, and to allow "straight on" application of the socket to the fitting (and "straight off" removal) independent of orientation of the facets of the fitting relative to the socket. A gear (or gears) is provided to drive the socket.

It is therefore an object of this invention to provide an improved tool for manipulating a fitting, such as a line fitting.

It is another object of this invention to provide an improved split socket and drive transfer assembly.

It is another object of this invention to provide a split socket and drive assembly for manipulating line fittings which is configured to minimize the necessity of manual manipulation to achieve positioning on a fitting, operation of the device and removal of the socket from the fitting.

It is another object of this invention to provide a split socket having a movable facet or facets.

It is yet another object of this invention to provide a tool, such as a split socket, which rotates a fitting when driven in one direction and which, when driven in the opposite direction, does not appreciably rotate the fitting.

It is still another object of this invention to provide a split socket and drive assembly configured to allow "straight on" application of the socket to a fitting (and "straight off" removal) independent of orientation of the facets of the fitting relative to the socket.

It is yet another object of this invention to provide a gear driven split socket for rotating a threaded fitting that includes a socket body having an inner periphery and an outer periphery that is engageable with the gear for rotation of said socket body in either of first and second directions, and a fitting contacting member pivotably attached at the inner periphery of the socket body for contacting the threaded fitting to rotate the threaded fitting when the socket body is rotated in the first direction and for contacting and pivoting away from the threaded fitting without substantial rotation of the threaded fitting when the socket body is rotated in the second direction.

It is still another object of this invention to provide a tool for manipulating a fitting having a plurality of sides, the tool including a manipulable body having an inner periphery, the inner periphery having first and second opposing, substantially parallel surfaces defining a fitting receiving gap in the body and being spaced apart a distance at least equal to the greatest diameter of the fitting to be manipulated, and at least a first member having a facet for contacting at east one side of the fitting to manipulate the fitting, the first member being pivotably mounted adjacent to one of the surfaces of the inner periphery of the body.

It is yet another object of this invention to provide a device for manipulating a threaded line fitting while the fitting is in place around the line, the device for releasable engagement with a power driver, the device including a split socket having an inner periphery and an engageable outer periphery together defining a part of a side wall, the side wall having a gap therein to allow positioning of the socket around the fitting, the inner periphery having first and second opposing surfaces with a first member movably maintained adjacent to the first surface and a second member movably maintained adjacent to the second surface, and a compact drive transfer assembly including a housing having the split socket rotatably mounted therein, the housing having a gap at one part thereof substantially corresponding in one dimension to the gap in the side wall of the socket, and drive means mounted in the housing for imparting rotational motion to the socket and having a portion configured to be releasably engaged with the driver, the gaps being in register when the socket is rotated to a selected position.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figures 1, 2:
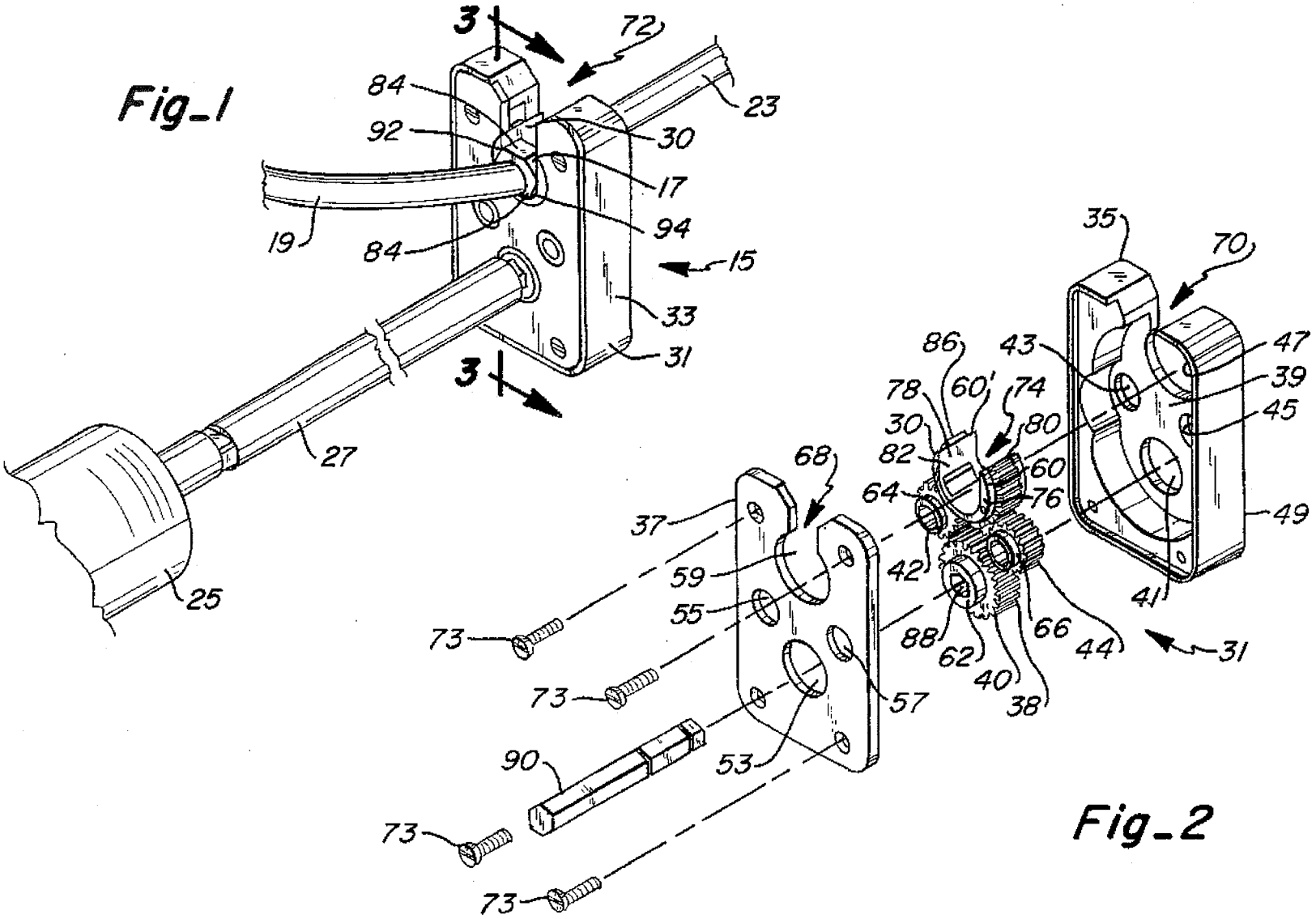
FIG. 1 is a perspective view showing both the split socket and drive assembly of this invention.
FIG. 2 is an exploded view of the units of FIG. 1.
Figure 3:
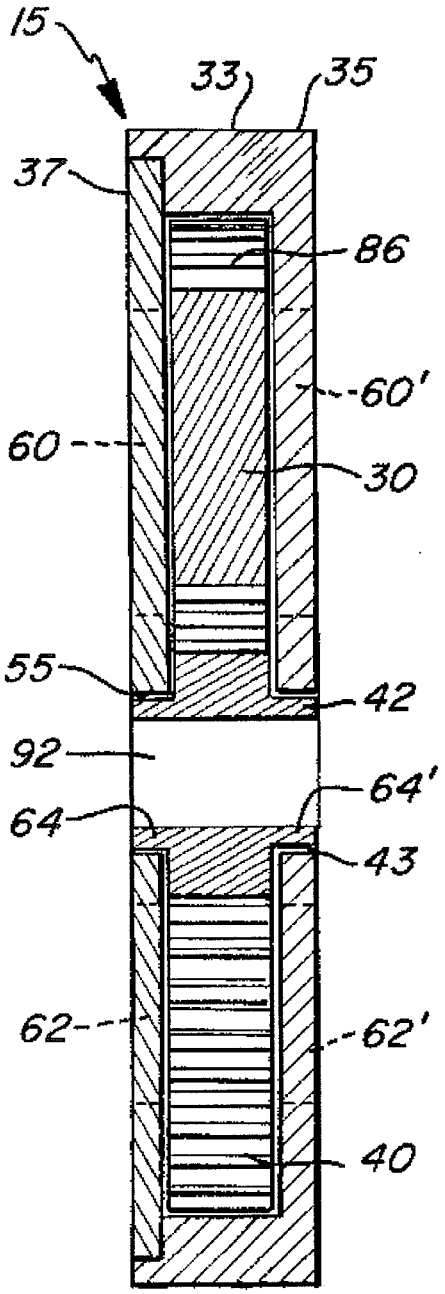
FIG. 3 is a sectional view taken through section line 3—3 of FIG. 1.

A first embodiment 15 of the split socket and drive transfer assembly of this invention is illustrated in FIGS. 1 through 3. Device 15 is shown in FIG. 1 in use to manipulate line fitting 17 around line segment 19 into engagement or disengagement with a matable fitting (not shown) around line segment 23. Device 15 is releasably engaged with power driver 25 using flexible shaft 27 (any suitable connection could be utilized).

Device 15 includes split socket 30 and drive transfer assembly 31. Drive transfer assembly 31 includes housing 33, formed by main housing body 35 and cover section 37, and gear train 38 including main drive gear 40 and linkage gears 42 and 44 for imparting rotational motion to socket 30 when driven by driver 25. Housing body 35 has indented structure 39 formed therein and openings 41, 43, 45 and 47 through rear wall 49 for housing socket 30 and gear train 38. Cover section 37 includes openings 53, 55, 57 and 59, the corresponding openings in body 35 and cover section 37 receiving arcuate shoulders 60, 60', 62, 62', 64, 64', and 66, 66' (66' not shown but being substantially the same as 64') of socket 30 and gears 40, 42 and 44, respectively, thus eliminating any need for axles, shafts, bearings and the like.

Both cover section 37 and main body 35 include gaps 68 and 70, respectively extending from openings 59 and 47, respectively, the thus formed gap 72 in housing 33 (when assembled, utilizing, for example, machine screws 73) corresponding in size to gap 74 formed in side wall 76 of socket 30 between spaced edges, or surfaces, 78 and 80 thereof. Side wall 76 is defined between inner periphery 82 for receiving the connector to be manipulated (as shown herein a hex fitting configuration with a plurality of facets 84) and the outer periphery of the socket which includes engagable outer periphery 86 as well as the outer periphery of shoulders 60 and 60'.

Drive gear 40 includes power driver attachment opening 88 for receipt of a rotatable shaft (such as flex shaft 27 or rigid shaft 90). Gear 40 and socket 30 may be sized relative to one another as desired, for example to provide gear reduction. The housing, socket and gears are preferably formed of metals, though various plastics could be utilized in some applications for some of the parts of the device. While various sizes of device 15 are employed depending upon the size of connector involved, all are compact relative to the task, compactness, as well as durability, being achieved because of the particular relationship of gap size and gear sizes and/or placement of gears.

In one particularly useful embodiment of the device, gap 74 in socket 30 and gap 72 in housing 33 are equal to or, preferably, greater than the greatest diameter of fitting 17 (i.e., the distance between opposite points 92 and 94 of the fitting for a hex nut, for example, in FIG. 1). In this manner, the fitting can be passed directly through the gaps into or out of inner periphery 82 of socket 30. Thus, no clearance above or below the fitting is required to achieve socket engagement or disengagement when gaps 74 and 72 are aligned.

Figure 4A:
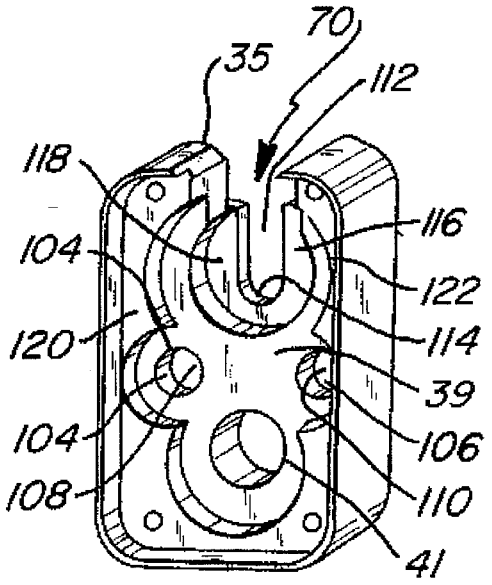
FIGS. 4A and 4B are perspective views of alternative housing designs preferable for utilization with this invention.
Figure 5:
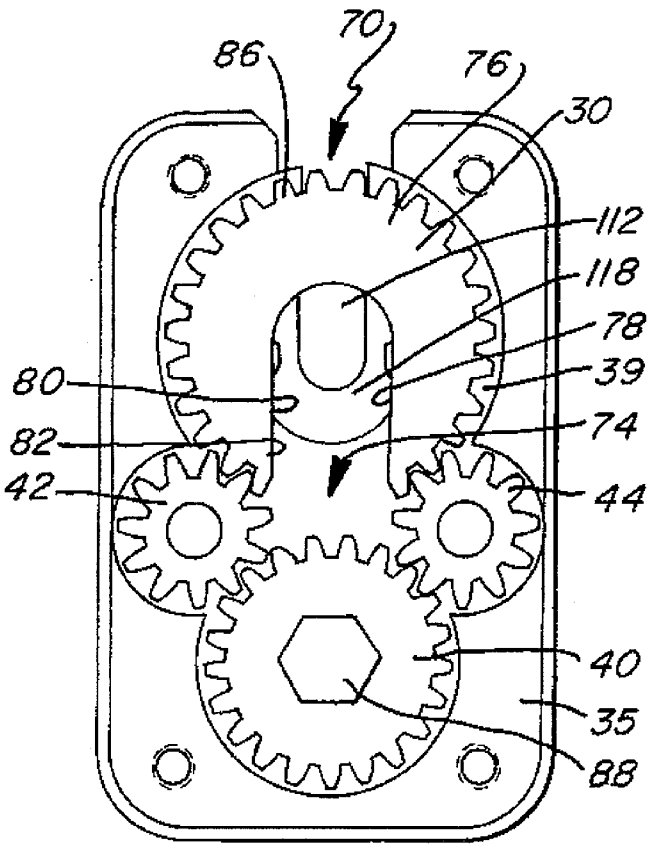
FIG. 5 is sectional illustration showing the drive assembly positioned in the housing of FIG. 4A.

FIGS. 4A and 5 show a preferred alternative design for main body 35 of housing 33 which is usable with threaded connector manipulating devices as heretofore described. Many features of main body 35 remain the same, including indented structure 39 and opening 41. However, instead of openings for gears 42 and 44, cavities 104 and 106 are provided which are closed at ends 108 and 110, respectively. In addition, line opening 112 has a dimension greater than line 19 but less than gap 70 to its terminus at end 114. Webbed fitting receiving pocket 116 is thus provided having back wall 118. Together, increased housing strength against flexure at shoulders 120 and 122 under applied torque (about 100% greater than the other design shown herein) and/or the ability to construct the housing of less expensive materials is provided by this alternative design. Moreover, wall 118 provides a positive stop for fasteners received in socket 30, thus assuring proper alignment of the fastener therein.

Figure 4B:
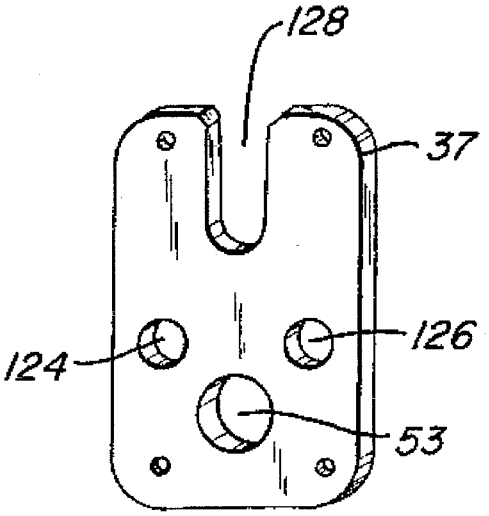

FIG. 4B illustrates an alternative design for cover section 37, again with many similarities to that heretofore described. Again, cavities 124 and 126 may be provided for linkage gears 42 and 44 rather than openings, and line opening 128 provides increased strength and a positive stop (it should be noted, of course, that while both could be so constructed for application in a single housing, only one or the other of openings 112 and 128 of housing body 33 and cover 37 is provided in this fashion for most applications).

FIG. 5 illustrates the relationship of gap 74 in socket 30 to gears 42 and 44 to assure constant running of socket 30 (i.e., one or the other of gears 42 and 44, and for most of a rotation both, will always be in driving engagement with socket 30). The particular socket and drive assembly housing shown in FIG. 5 is sized for a small line fitting, for example as are used for electrical and cable connectors.

Figure 6:
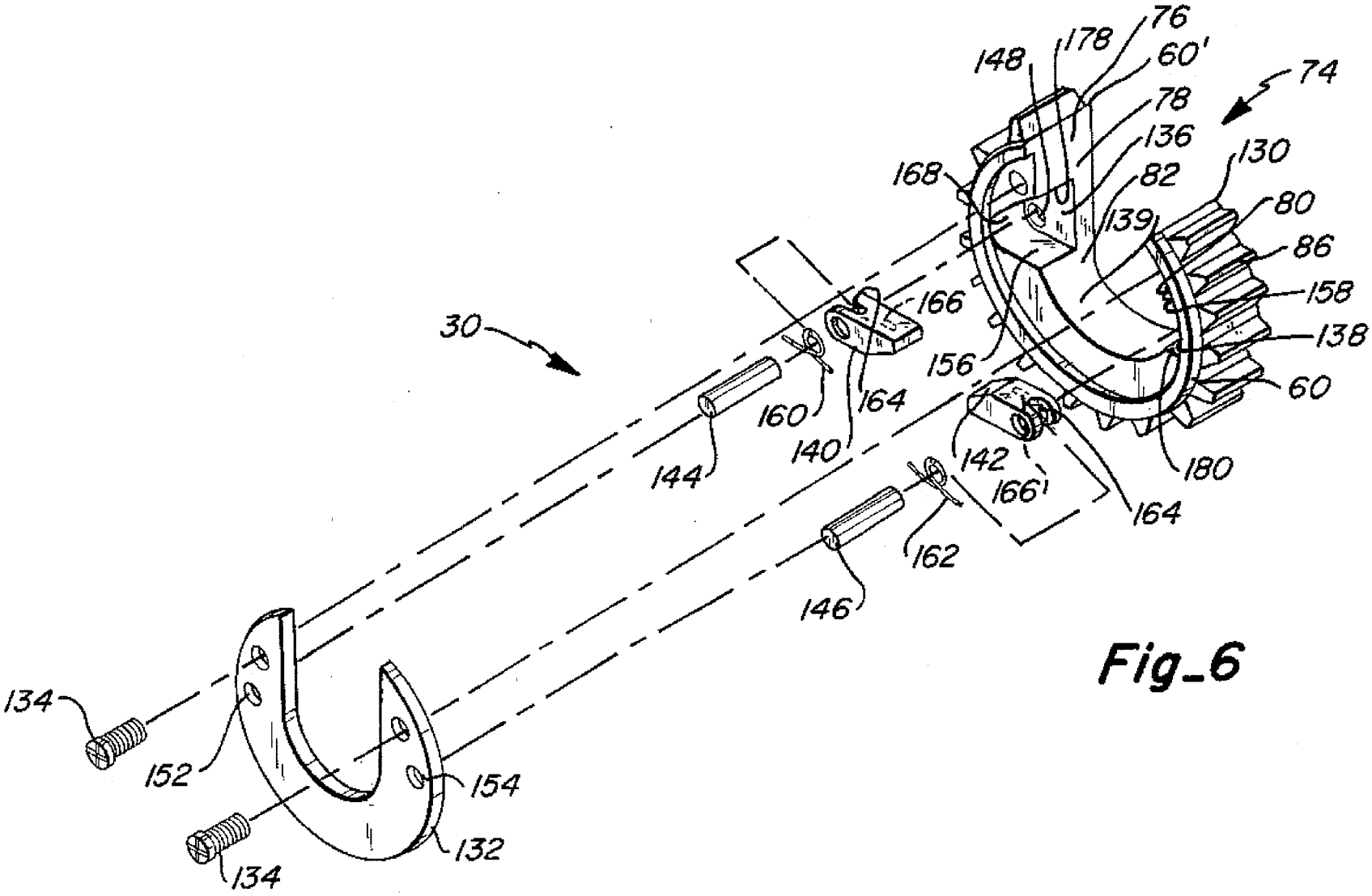
FIG. 6 is an exploded view of the split socket having movable facets of this invention.

FIG. 6 shows the preferred embodiment of split socket 30, including socket body 130 and cover portion 132 connectable by connectors 134. Socket body 130 includes indented structures 136 and 138 at surfaces 78 and 80, respectively, of side wall 76. Surfaces 78 and 80 terminate at arcuate surface 139 below indented structures 136 and 138, surface 139 serving as a positive stop (and, in part, a bearing surface) for fitting 17 at inner periphery 82 of socket 30. Dog members 140 and 142 are pivotably mounted on shafts 144 and 146, respectively, in structures 136 and 138, respectively, shafts 144 and 146 being maintained in cavities 148 in indented structures 136 and 138 in socket body 130 (only one of which is shown in FIG. 6 in structure 136, a like cavity being positioned in structure 138) and cavities 152 and 154, respectively, in cover portion 132.

Dog members 140 and 142 are biased toward stop walls 156 and 158 of structures 136 and 138, respectively, by torsion springs 160 and 162, respectively, mounted around their respective shafts and housed in gaps 164 of the respective dog member. Springs 160 and 162 each have one end maintained in holes 166 of the respective dog member and the other end maintained in holes 168 of their respective indented structure (only one of which is shown in structure 136 in FIG. 6).

Figure 7:
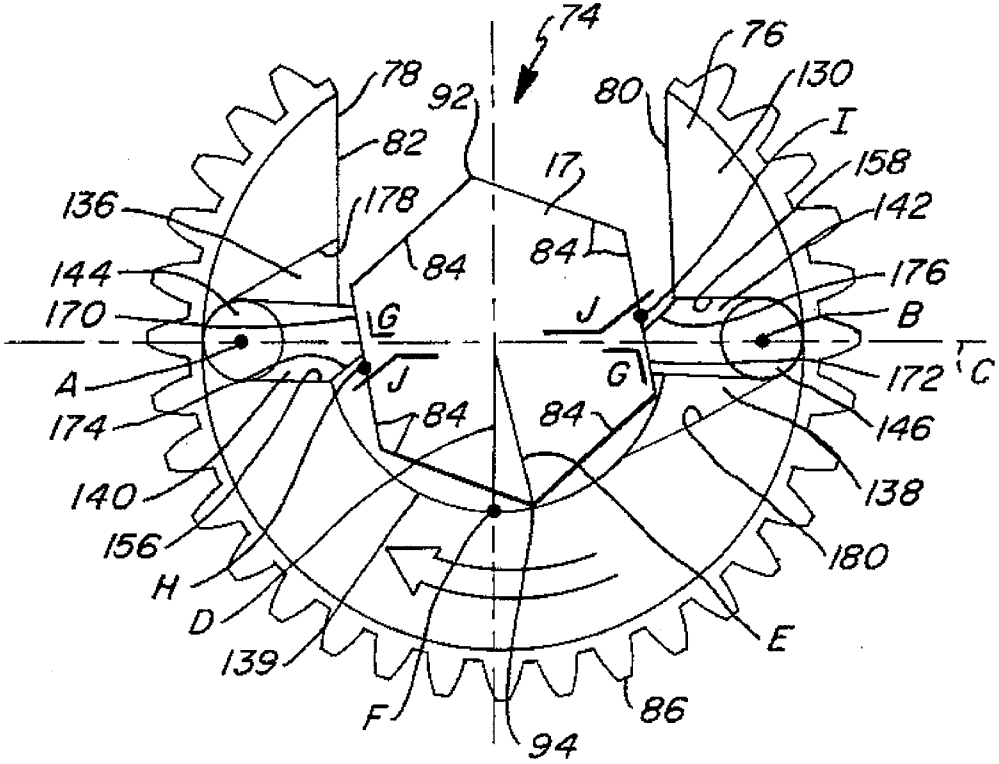
FIG. 7 is an illustration of the spatial relationships of the movable facets and the socket body.

FIG. 7 illustrates the preferred relative placement and angles of the indented structures, dog members and pivot points in wall 76 of socket body 130 for any particular size of fitting 17 to be manipulated (other angles, placement, facet sizes and the like could, of course, be utilized). Shafts 144 and 146 are mounted so that pivot points A and B define line C which is substantially perpendicular to surfaces 78 and 80. Proper joint positioning of the pivot points along the surfaces is determined by the size of the fitting 17 to be manipulated by socket 30. Line D (terminating at arcuate surface 139) is equal in length to line E, which is one-half of the widest diameter of fitting 17 (in FIG. 7 shown as the point 92 to point 94 diameter of a hex fitting). Line D is defined by the dashed line bisecting gap 74 and arcuate surface 139 (running through arcuate surface center point F). Thus, line C (when the pivot points are properly positioned) is perpendicular to line D, the lines intersecting at approximately the center of a fitting to be inserted in socket 30.

Facets 170 and 172 of members 140 and 142 for engaging to rotate fitting 17 are preferably fully contacted by facets 84 of fitting 17 at about zero to 20° (preferably about 15°) of relative rotation (15° of movement of point F of arcuate surface 139 relative to point 94 of fitting 17). Thus, where the fitting is a hex fitting, when the facets fully contact the sides of the fitting to rotate the fitting, about zero to 20° (preferably about 15°) of relative rotation between surfaces 78 and 80 of inner periphery 82 of socket 30 and the contacted sides, or facets 84, of the hex fitting is maintained (plus or minus 15° in FIG. 7 depending on the surface 78/80 and facet 84 pair being considered).

This relationship may be brought about using the preferred angles G of facets 170 and 172 relative to line C (about 90° to 110°, preferably about 105°). Facets 170 and 172 are of a length less than one-half the length of one facet 84 of fitting 17. Members 140 and 142 are of a 2length from pivot points A and B to facets 170 and 172, respectively, sufficient to allow a meeting along the entire facets 170/172 surfaces with facets 84 of the fitting when fully engaged (preferably, the length of members 140 and 142 is equal to about one-half of the distance between points H and I, each defined as a midpoint of a facet 84). Stop walls 156 and 158 are positioned so that, upon full engagement of fitting 17 by facets 170/172, the facets are located at one side of midpoints H and I of fitting 17 (one above and one below the midpoints as shown in FIG. 7).

Angles J represent the angular relationship between facets 174 and 176 of members 140 and 142 and line C (preferably about 135°). Facets 174 and 176 are contacted by fitting 17 when rotation of socket 30 is opposite that illustrated in FIG. 7, being then pivoted away toward walls 178 and 180 of structures 136 and 138, respectively. Walls 178 and 180 are positioned to allow sufficient pivoting of members 140 and 142 so that facets 174 and 176 are at least about aligned with surfaces 78 and 80, respectively, when fully pivoted (see FIG. 8C).

Figure 8A:
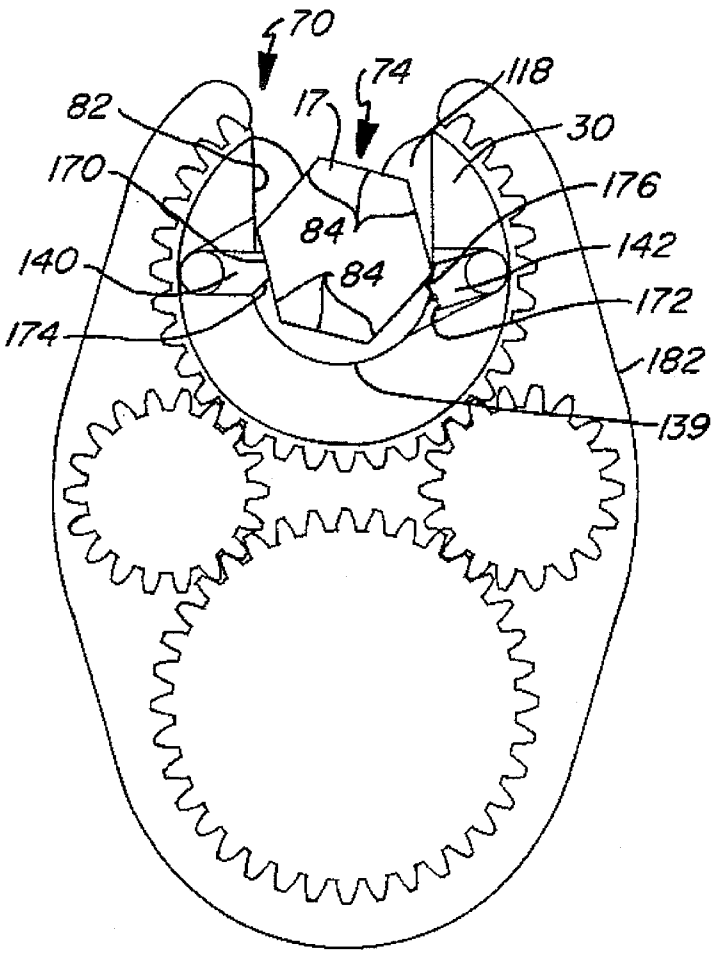
FIGS. 8A through 8C illustrate operation of the split socket of this invention and yet another alternative housing design.
Figure 8C:
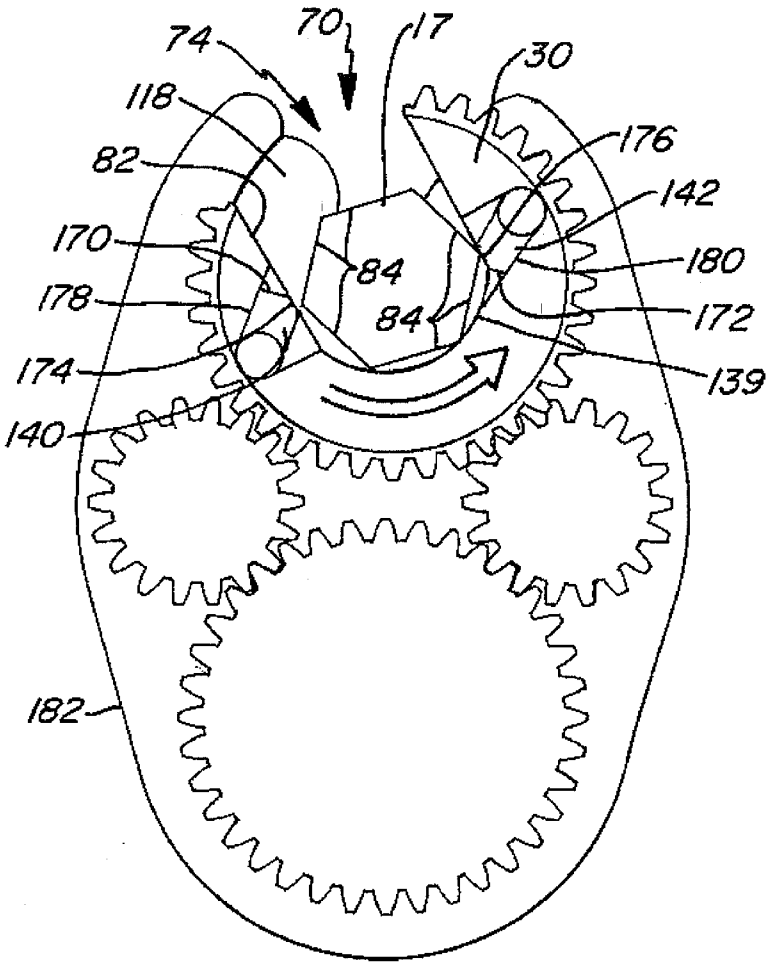
Figure 8B:
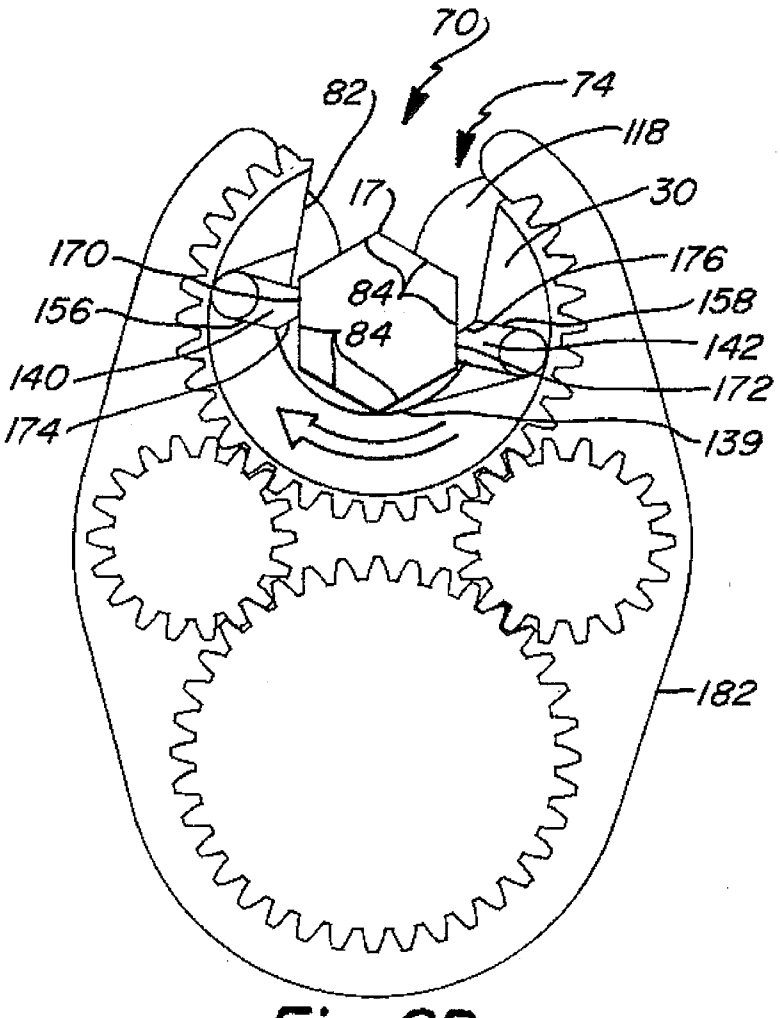

FIGS. 8A through 8C illustrate operation of split socket 30 of this invention in a housing 182 which is similar in most regards to that heretofore described except for overall shape. In FIG. 8A, fitting 17 is being received in socket 30 directly through gaps 70 and 74 in housing 182 and socket 30, respectively. As illustrated, alignment of facets 84 of fitting 17 to allow receipt at inner periphery 82 of socket 30 is unnecessary, since member 142 will pivot to allow receipt of fitting 17 where necessary irrespective of orientation of the facets of fitting 17.

FIG. 8B illustrates the fitting in place contacting arcuate surface 139 and wall 118 thus assuring proper alignment, and with socket 30 having been rotated about 15° (by a driver as illustrated in FIG. 1) bringing facets 170 and 172 of members 140 and 142 into full contact with facets 84 of fitting 17 and with the members at stop walls 156 and 158. Continued rotation in the direction illustrated thus will rotate fitting 17 (the directions of fitting rotation can be reversed simply by reversing the tool on the fitting).

FIG. 8C illustrates the contact by members 140 and 142 at facets 174 and 176 with the fitting to thereby pivot members 140 and 142 toward walls 178 and 180 when socket 30 is rotated in the opposite direction to that shown in FIG. 8B. In this manner, the socket may be rotated (for example to achieve correspondence of gaps 70 and 74 of the housing and socket, respectively) while fitting 17 remains substantially still.

Figure 9:
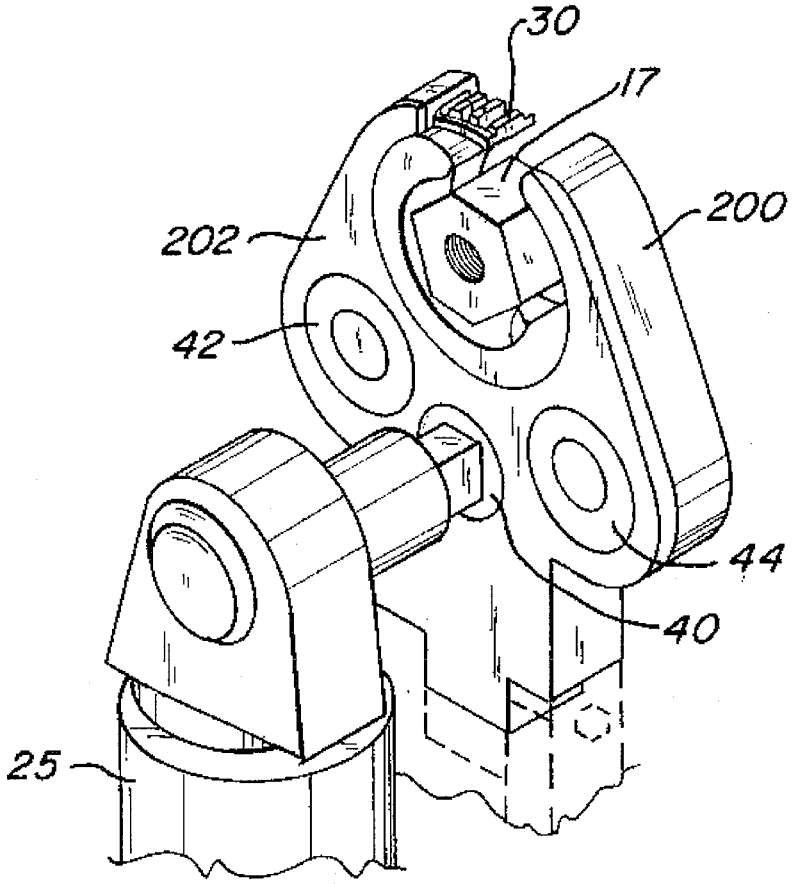
FIG. 9 is a perspective view of another embodiment of this invention.
Figure 10:
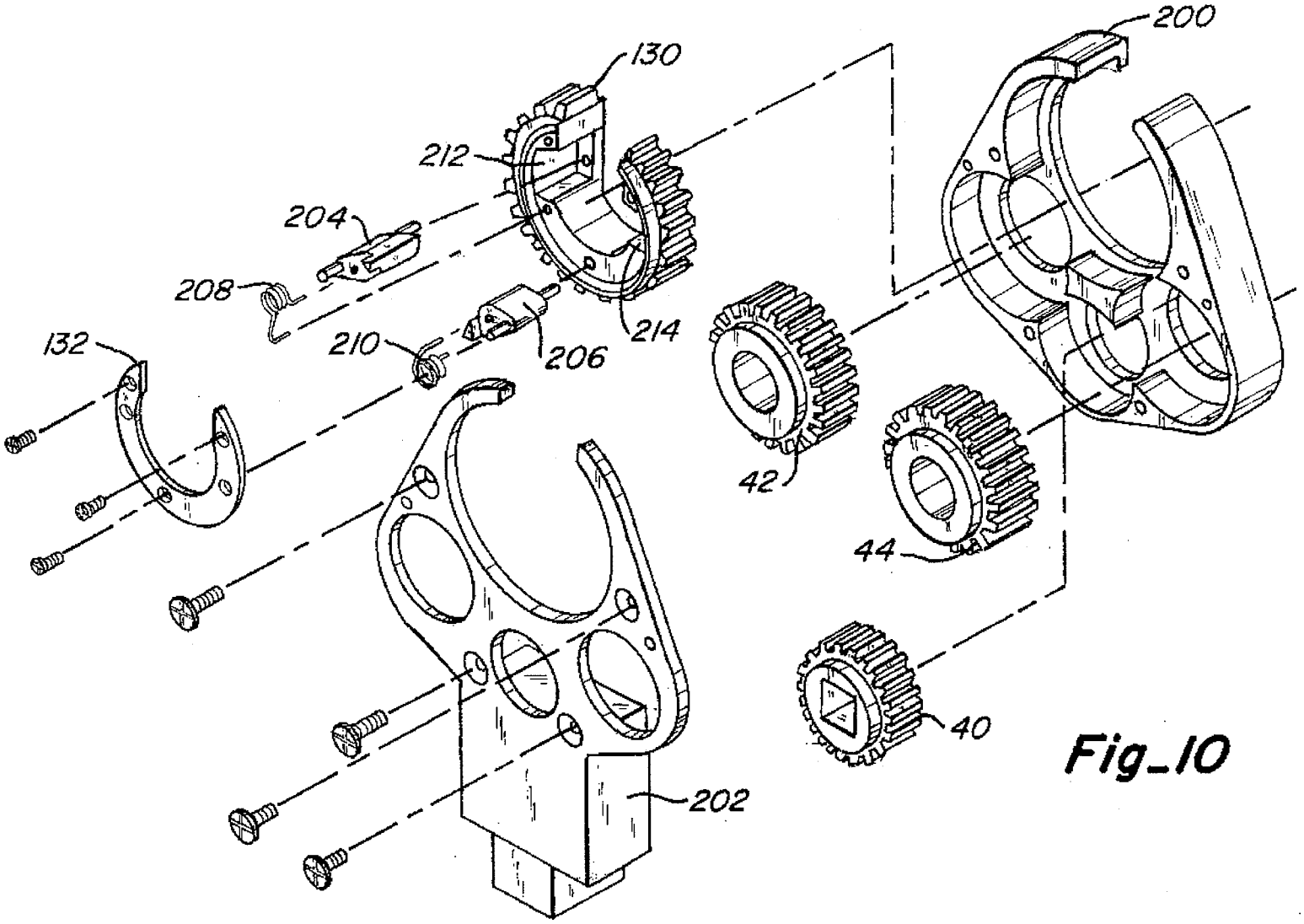
FIG. 10 is an exploded view of the embodiment of the invention shown in FIG. 9.

FIGS. 9 and 10 illustrate another embodiment of this invention similar in most regards to those discussed hereinabove, but with housing body 200 and cover section 202 adapted for larger fittings (and thus the larger gap necessary between linkage gears 42 and 44). In addition, unitary shaft and dog member assemblies 204 and 206 are utilized, with torsion springs 208 and 210 being engaged at the top of the assemblies and indented structures 212 and 214.

Figure 11:
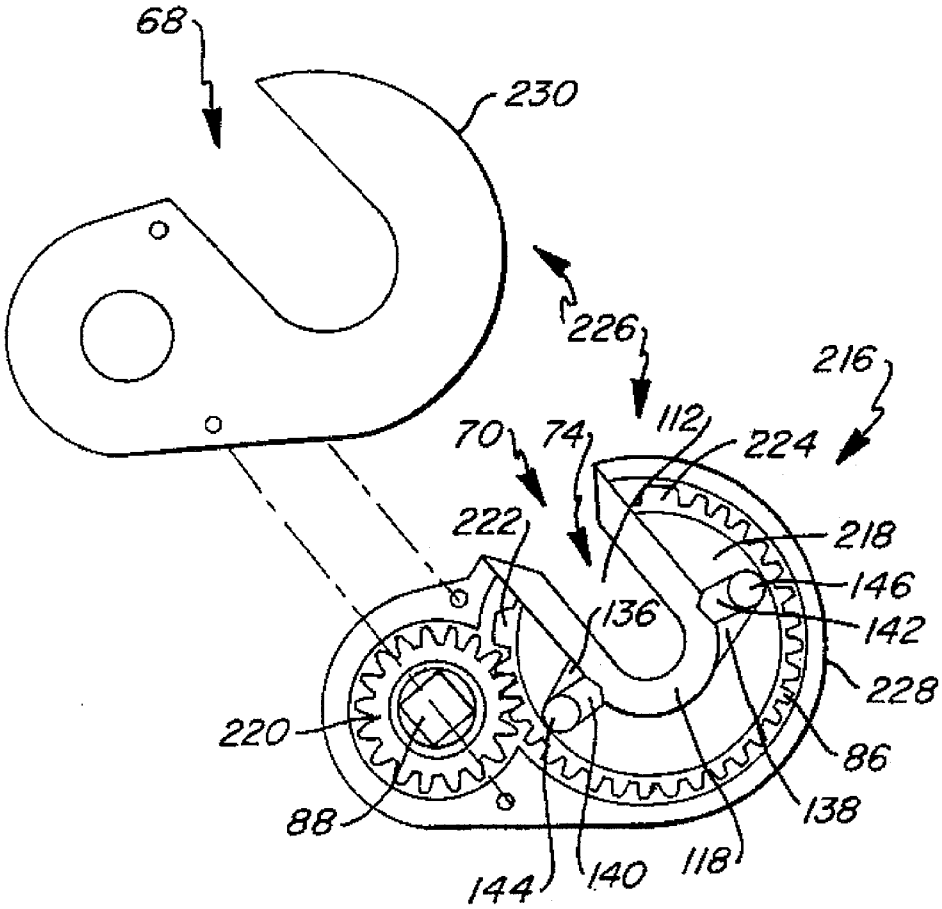
FIG. 11 is a partially exploded illustration of another embodiment of this invention for a direct drive assembly and ratcheting type operation.

FIG. 11 illustrates another embodiment of this invention, with device 216 configured so that socket 218 is directly driven by drive gear 220. Split socket 218 is the same in most regards as that illustrated in FIGS. 6 and 7, but with stop cogs 222 and 224 at outer engageable periphery 86 thereby disallowing engagement of drive gear 220, and thus travel of the socket, therebeyond. Cog 222 is positioned so that gap 74 in socket 218 and gap 70 in housing 226 (defined by housing body 228 and cover section 230) are aligned as shown in the FIGURE when socket 218 is driven in the counterclockwise direction (directions are relative to the orientation of the tool on the fitting), thus providing automatic centering of the gaps. Cog 224 is positioned to allow the maximum rotation of the socket in the clockwise direction without disengagement of socket 218 and drive gear 220. When cog 24 blocks further rotation, the direction of rotation is reversed, the fitting remaining substantially still during counter rotation to cog 222 as heretofore discussed.

This device can be driven manually (with a rotatable ratchet handle engaged at opening 88) or with a power driver to manipulate fittings in a ratcheting fashion. Furthermore, microswitches or the like could be employed to automatically reverse a power driver's direction of rotation when cogs 222 and/or 224 have been engaged at drive gear 220.

Figure 12:
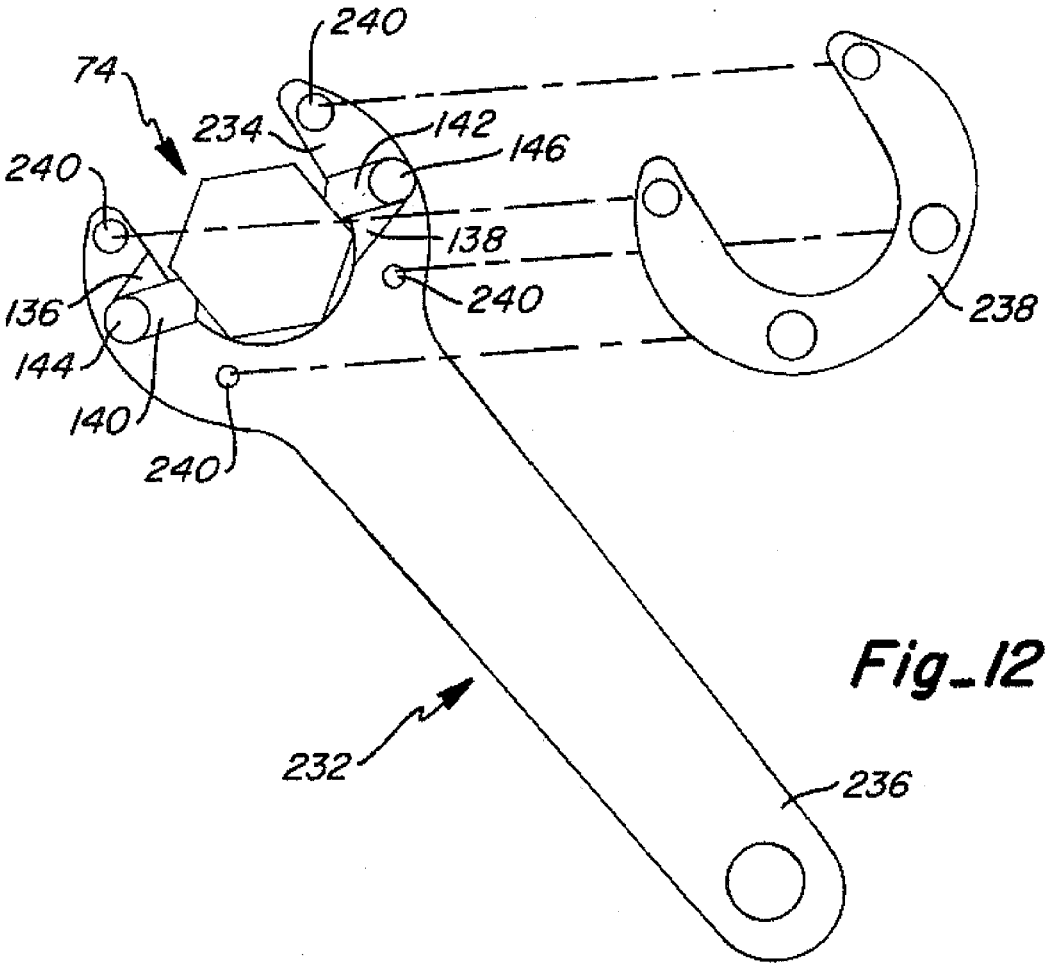
FIG. 12 is an exploded illustration of the socket of this invention configured for use with a handle.

FIG. 12 illustrates the simplest embodiment of the split socket of this invention configured as a ratchet wrench 232. As before, gap 74 is sized, and members 140 and 142, structures 136 and 138 and inner periphery 82 are positioned in wrench head 234 connected with handle 236, as described for socket 30 and as shown in FIGS. 6 and 7. Cover section 238 is attached to wrench head 234 utilizing screws or the like through openings 240.

As may be appreciated, where eccentric running of the socket is no problem, for example in manually driven applications as discussed herein or in slow speed power applications, the socket (or wrench head) of this invention may be utilized with only one dog member 140 or 142 (with gap 74 being appropriately sized) and utilizing surface 78 or 80 opposite the one dog member (or other appropriately configured fixed structure) to hold the fitting once engaged between the dog member and surface for rotation. As heretofore described, the one pivoting member 140 or 142, provided with sufficient range of arc, could in such case be contacted and moved away from the fitting upon opposite rotation so that the fitting remains substantially still.

Used in conjunction with any type of mechanism for bringing the gaps in the housing and in the socket into correspondence, either automatically or manually (as shown, for example, in FIG. 11 for ratcheting type applications; see also U.S. patent application Ser. No. 08/299,211 filed Aug. 31, 1994 and entitled "Mechanism For Locating A Slotted Socket Relative To A Drive Transfer Housing And Combination Thereof" by David Wilson Jr. and Bruce D. Stefen, the contents of which are incorporated hereinto by this reference, which illustrates auto-centering mechanisms for a drive transfer assembly similar to that shown in FIG. 1), this invention allows alignment of the gaps while the socket remains on the line fitting without significant movement of the fitting during the operation. In addition, gap size and socket configuration as taught herein allow "straight on" application of the socket to the fitting (and "straight off" removal) independent of orientation of the facets of the fitting relative to the socket, thus significantly enhancing flexibility and ease of use of the tool, particularly in confined fitting environments.

What is claimed is:

1. A split socket driven by a gear for rotating a threaded fitting comprising:

a socket body having an inner periphery and an outer periphery that is engageable with the gear for rotation of said socket body in either of first and second directions, said inner periphery having first and second spaced substantially parallel surfaces; and fitting contacting means pivotably attached at said inner periphery of said socket body for contacting the threaded fitting to rotate the threaded fitting when said socket body is rotated in said first direction and for contacting and pivoting away from the threaded fitting without substantial rotation of the threaded fitting when said socket body is rotated in said second direction, said fitting contacting means having a first facet surface for flush contact with a side surface of the threaded fitting to achieve rotation of the fitting, said facet surface being configured so that, upon flush contact with the side surface of the threaded fitting, said facet surface, and so the side surface of the threaded fitting, is positioned at an angle greater than 0° and less than about 20° relative to said first and second parallel surfaces of said inner periphery of said socket body.

2. The split socket of claim 1 wherein said fitting contacting means consists of first and second pivotably attached members.

3. The split socket of claim 1 wherein said first and second spaced surfaces of said inner periphery of said socket body define a gap in said socket body said inner periphery having an arcuate surface continuing said first and second surfaces at one end of each said surface, said fitting contacting means being pivotably attached adjacent to one of said first and second surfaces.

4. The split socket of claim 1 wherein said fitting contacting means includes a shaft engaged in said socket body adjacent to said inner periphery and a pivotable member at said shaft.

5. The split socket of claim 4 wherein said socket body has indented structure therein for mounting of said shaft and for accommodating pivoting away of said pivotable member when said socket body is rotated in said second direction.

6. The split socket of claim 5 wherein a stop wall is defined at one part of said indented structure against which said pivotable member bears while said fitting is rotated, said split socket further comprising biasing means for biasing said pivotable member toward said stop wall.

7. A tool for manipulating a fitting having a plurality of sides, said tool comprising:

a manipulable body having an inner periphery, said inner periphery having first and second opposing, substantially parallel surfaces defining a fitting receiving gap in said body and being spaced apart a distance at least equal to the greatest diameter of the fitting to be manipulated; and first and second members each having a facet for contacting a side of the fitting to rotate the fitting when said body is rotated in a first direction, each of said members being pivotably mounted adjacent to a different one of said surfaces of said inner periphery of said body, said facets of said members being configured so that, upon contact with the sides of the threaded fitting for rotation of the fitting, said facets, and so the sides of the threaded fitting, are positioned at an angle greater than 0° and less than about 20° relative to said first and second surfaces of said inner periphery of said manipulable body.

8. The tool of claim 7 wherein the fitting is a hex fitting, and wherein said facets are configured so that, when said facets fully contact the sides of the fitting to rotate the fitting, about 15° of relative rotation between said surfaces of said inner periphery of said body and the contacted sides of the hex fitting is maintained.

9. The tool of claim 7 wherein the contacted sides of the hex fitting are opposite sides each having a face with a midpoint, said facets being of a length so that the faces of the opposite sides are fully contacted by said facets only past the midpoints of the faces.

10. The tool of claim 7 wherein both of said members include second facets for contacting the fitting to pivot said members away from the fitting when said body is rotated in a second direction.

11. The tool of claim 7 wherein each of said members has a pivot point at said body positioned so that a line connecting said pivot points would be perpendicular to said surfaces of said inner periphery of said body.

12. The tool of claim 11 wherein said inner periphery of said body includes an arcuate surface continuing said first and second surfaces at one end of each said surface, said arcuate surface being positioned relative to said members so that a fitting contacts said arcuate surface when properly positioned for rotation in said body.

13. A device for manipulating a threaded line fitting while the fitting is in place around the line, said device for releasable engagement with a power driver, said device comprising:

a split socket having an inner periphery and an engageable outer periphery together defining a part of a side wall, said side wall having a gap therein to allow positioning of the fitting at said inner periphery of said socket, said inner periphery having first and second opposing surfaces with a first member movably maintained adjacent to said first surface and a second member movably maintained adjacent to said second surface, each of said members having a pivot point at said side wall positioned so that a line connecting said pivot points would be perpendicular to said surfaces of said inner periphery of said split socket; and a compact drive transfer assembly including a housing having said split socket rotatably mounted therein, said housing having a gap at one part thereof substantially corresponding in one dimension to said gap in said side wall of said socket, and drive means mounted in said housing for selectively imparting 360° rotational motion to said socket and having a portion configured to be releasably engaged witch the driver, said gaps being in register when said socket is rotated to a selected position.

14. The device of claim 13 wherein said drive means includes a primary drive gear rotatably mounted in said housing and having said portion thereat and linkage means mounted in said housing and configured to engage said primary drive gear and said outer periphery of said socket for imparting rotational motion to said socket when said primary drive gear is rotated by the driver.

15. The device of claim 13 wherein said gap in said side wall of said socket and said gap in said housing are at least equal in size to the greatest diameter of the fitting to be manipulated.

16. The device of claim 13 wherein said members are for contacting the fitting to rotate the fitting when said socket is rotated in a first direction and for contacting and pivoting away from the fitting without substantial rotation of the fitting when said socket is rotated in said second direction.

17. The device of claim 16 further comprising means for causing said socket to cease rotation when said gap in said wall of said socket and said gap in said housing are brought into correspondence by rotating said socket in said second direction.

18. The device of claim 13 wherein said housing includes a wall adjacent to said gap to provide a solid stop for proper positioning of the fitting when received at said inner periphery of said socket.

19. The device of claim 13 wherein said drive means is a gear engagable at said engageable outer periphery of said socket.

* * * * *